US007161102B2

(12) United States Patent
Yamagami

(10) Patent No.: US 7,161,102 B2
(45) Date of Patent: Jan. 9, 2007

(54) SWITCH DEVICE

(75) Inventor: Toru Yamagami, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/409,824

(22) Filed: Apr. 24, 2006

(65) Prior Publication Data

US 2006/0243573 A1 Nov. 2, 2006

(30) Foreign Application Priority Data

Apr. 28, 2005 (JP) ..... 2005-132743

(51) Int. Cl.
*H01H 1/36* (2006.01)

(52) U.S. Cl. ..... 200/252; 200/11 DA; 200/11 R

(58) Field of Classification Search ..... 200/252–261, 200/564, 11 DA, 11 R
See application file for complete search history.

(56) References Cited

U.S. PATENT DOCUMENTS 4,451,715 A * 5/1984 Neese ..... 200/11 G
4,640,995 A * 2/1987 Naaijer ..... 200/11 DA
4,892,984 A * 1/1990 Clark et al. ..... 200/61.86
5,539,165 A * 7/1996 Wu ..... 200/43.08
5,923,008 A * 7/1999 Williams, Jr. ..... 200/14
6,396,006 B1 * 5/2002 Yokoji et al. ..... 200/4
6,667,446 B1 * 12/2003 Schuberth et al. ..... 200/4
6,828,517 B1 * 12/2004 Calkin et al. ..... 200/11 DA

FOREIGN PATENT DOCUMENTS

JP 2004-127677 4/2004

* cited by examiner

*Primary Examiner*—Richard K. Lee
(74) *Attorney, Agent, or Firm*—Brinks Hofer Gilson & Lione

(57) ABSTRACT

A switch device including a first fixed contact, a second fixed contact, a lead-out pattern extending from the second fixed contact to the outside of the first fixed contact, and a movable contact disposed on the first fixed contact and formed of a reversing leaf spring is provided. The first fixed contact includes a pair of cutout ends opposing each other across an exposed insulating portion of an insulating substrate. A pair of first overlay films having a predetermined thickness are respectively provided on the cutout ends. A second overlay film is provided on the first overlay films and on the insulating portion disposed on the lead-out pattern.

4 Claims, 2 Drawing Sheets

SWITCH DEVICE

BACKGROUND OF THE INVENTION

1. Field of the Invention

The present invention relates to a switch device, and more particularly, to a switch device having a lead-out pattern extending from a second fixed contact provided inside a first fixed contact is covered with an insulating film.

2. Description of the Related Art

A switch device disclosed in Japanese Unexamined Utility Model Registration Application Publication No. 61-68432 will be described with reference to FIGS. 3 and 4. In a switch device 21 shown in FIGS. 3 and 4, a peripheral contact 23 having a broken annular shape is formed on an insulating substrate 22, for example, by printing with silver ink. The peripheral contact 23 includes a cutout portion having a predetermined width, and cutout ends 23*a*. The insulating substrate 22 is exposed between the cutout ends 23*a*.

A portion of the insulating substrate 22 exposed between the cutout ends 23*a* includes a pair of protuberances 22*a* that are arranged at a predetermined distance from each other and are formed by extrusion. The height of the protuberances 22*a* is more than the thickness of the peripheral contact 23.

A center contact 24 is provided inside the peripheral contact 23, and is made of the same material as that of the peripheral contact 23. A lead-out pattern 24*a* extends from the center contact 24 to the outside of the peripheral contact 23. The lead-out pattern 24*a* is routed between the protuberances 22*a*, and is led to the outside.

The lead-out pattern 24*a* is thinner than the protuberances 22*a*. A dome-shaped elastic reversing leaf spring (not shown) is positioned on the peripheral contact 23 and on the protuberances 22*a*.

A predetermined space is provided between an outer peripheral portion of the reversing leaf spring and the lead-out pattern 24*a* so that the reversing leaf spring is electrically insulated from the lead-out pattern 24*a*.

Operation of the switch device 21 will be described. When the top of the reversing leaf spring, which is disposed on the peripheral contact 23 and the protuberances 22*a* and is dome-shaped in an initial state, is pressed, the reversing leaf spring is reversed, and a ceiling face of the reversing leaf spring touches the center contact 24. Consequently, the peripheral contact 23 is electrically connected to the center contact 24 via the reversing leaf spring, and a switch circuit is turned on.

When the press of the reversing leaf spring is removed, the reversing leaf spring automatically returns to the initial dome shape by its own elasticity, and the switch circuit is turned off.

Although the outer peripheral portion of the reversing leaf spring and the lead-out pattern 24*a* are insulated by the protuberances 22*a*, if dust, such as metal powder, enters the space between the reversing leaf spring and the lead-out pattern 24*a*, it may electrically connect the reversing leaf spring and the lead-out pattern 24 in the initial state before the reversing leaf spring is pressed. This causes improper operation.

For example, when the insulating substrate 22 is a flexible printed board, the protuberances 22*a* projecting from the insulating substrate 22 are worn and reduced in height by repetitive pressing of the reversing leaf spring. This may also cause improper operation.

SUMMARY OF THE INVENTION

In order to overcome the above-described problems, it is an object of the present invention to provide a switch device in which a movable contact formed of a reversing leaf spring can be reliably insulated from a lead-out pattern even when operated repeatedly, and which has superior life property.

A switch device according to an aspect of the present invention includes an insulating substrate; a first fixed contact that has a broken annular shape and that is cut out to form a cutout portion having a predetermined width so that a part of the insulating substrate is exposed from the cutout portion, the first fixed contact including a pair of cutout ends opposing each other across the part of the insulating substrate; a second fixed contact provided inside the first fixed contact so as to be insulated from the first fixed contact; a lead-out pattern extending from the second fixed contact to the outside of the first fixed contact; a movable contact provided on the first fixed contact and formed of a reversing leaf spring; a pair of first overlay films having a predetermined thickness and respectively provided on the cutout ends of the first fixed contact; and a second overlay film having a predetermined thickness and provided on the first overlay films, the part of the insulating substrate, and the lead-out pattern.

In this case, even when the second overlay film is worn by repeatedly pressing the movable contact, the first overlay films prevent the movable contact from touching the lead-out pattern. This improves the life property of the switch device.

Preferably, the sum of the thickness of the cut out ends, the thickness of the first overlay films, and the thickness of portions of the second overlay film disposed on the first overlay films is more than the sum of the thickness of the lead-out pattern and the thickness of a portion of the second overlay film provided on the lead-out pattern.

In this case, even when the second overlay film is worn by repeatedly pressing the movable contact, the outer peripheral portion of the movable contact touches a portion of the second overlay film provided on the lead-out pattern, and the first overlay films.

For this reason, the contact area of the outer peripheral portion of the movable contact with the first and second overlay films is increased, and wear of the first and second overlay films is reduced.

Preferably, the first overlay films are made of the same material as a carbon film that covers a terminal of the first fixed contact, and the second overlay film is a resist film.

In this case, the first overlay films can be printed simultaneously with printing of the terminal, and workability is enhanced.

Moreover, since the second overlay film is a resist film, it can be printed simultaneously with printing a resist film in a peripheral circuit.

Preferably, the first overlay films are 10 μm in thickness, and the second overlay film is 15 μm in thickness.

In this case, wear of a portion of the second overlay film on which the outer peripheral portion of the movable contact is placed is retarded, and the life property of the switch device is improved.

DESCRIPTION OF THE PREFERRED EMBODIMENTS

Figure 1:
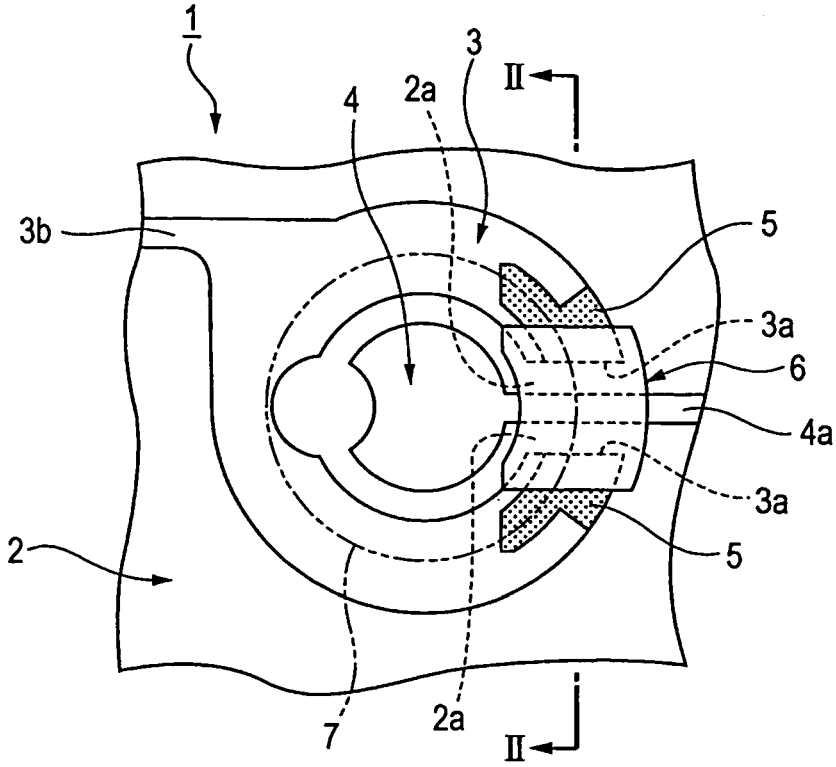
FIG. 1 is a plan view of a switch device according to an embodiment of the present invention.
Figure 2:
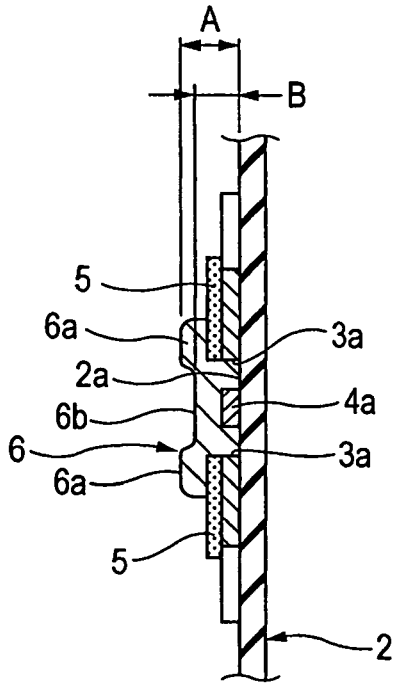
FIG. 2 is a cross-sectional view taken along line II—II in FIG. 1.
Figure 3:
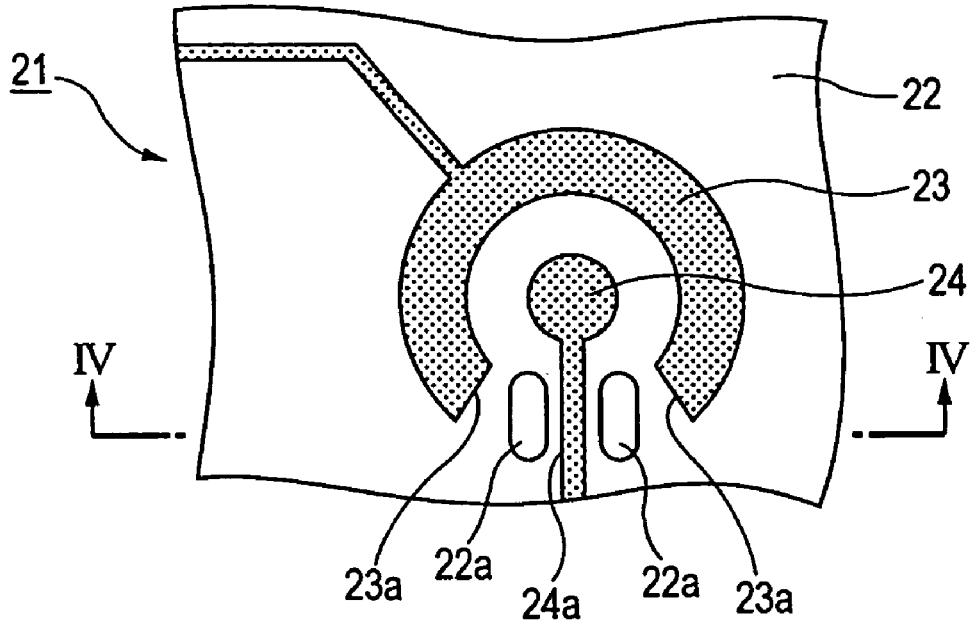
FIG. 3 PRIOR ART
FIG. 3 is a plan view of a known switch device.
Figure 4:
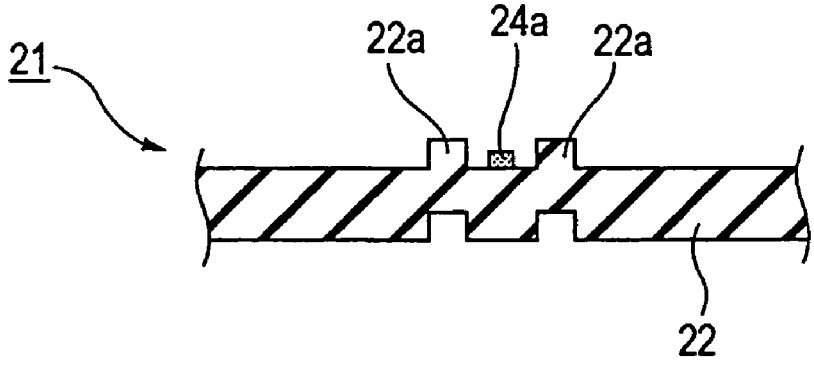
FIG. 4 PRIOR ART
FIG. 4 is a cross-sectional view taken along line IV—IV in FIG. 3.

A switch device according to an embodiment of the present invention will be described below with reference to the drawings. FIG. 1 is a plan view of the switch device of the embodiment, and FIG. 2 is a cross-sectional view taken along line II—II in FIG. 1. Referring to FIGS. 1 and 2, a switch device 1 of the embodiment includes a flexible insulating substrate 2 such as a flexible printed board, and a first fixed contact 3 having a broken annular shape. The first fixed contact 3 is printed on the insulating substrate 2, for example, in conductive silver ink.

The first fixed contact 3 is cut out on one side, that is, on the right side in FIG. 1 to form a cutout portion having a predetermined width, and to be substantially horseshoe-shaped. In the cutout portion of the first fixed contact 3, cutout ends 3*a* having a predetermined width oppose each other. An insulating portion 2*a* of the insulating substrate 2 is exposed between the cutout ends 3*a*.

A long conduction pattern 3*b* extends from the first fixed contact 3 to the left in FIG. 1, and is connected to a terminal portion (not shown) provided at an end of the insulating substrate 2.

For example, a protective film (not shown) is printed in carbon ink on the conduction pattern 3*b* of silver ink in order to prevent the conduction pattern 3*b* from separating when an external connector is fitted in the terminal portion.

The protective film can also prevent the conduction pattern 3*b* from sulfuration, oxidation, and salification.

A second fixed contact 4 is provided inside the first fixed contact 3 on the insulating substrate 2. The second fixed contact 4 is insulated from the first fixed contact 3, and is printed in the same material of the first fixed contact 3, for example, silver ink.

A lead-out pattern 4*a* extends from the second fixed contact 4. The lead-out pattern 4*a* is routed on the insulating portion 2*a* between the cutout ends 3*a*, and is led to the outside of the first fixed contact 3.

A pair of first overlay films 5 are respectively printed on the cutout ends 3*a* of the first fixed contact 3. The first overlay films 5 are made of the same material as that of the protective film provided on the conduction pattern 3*b* in the terminal portion, for example, carbon ink. The first overlay films 5 can be formed simultaneously with printing of the protective film on the conduction pattern 3*b*.

The first overlay films 5 are provided on the cutout ends 3*a* so as to have a thickness of approximately 10 μm and have a predetermined size.

A second overlay film 6 having a predetermined thickness and made of, for example, resist ink is provided on the first overlay films 5, the insulating portion 2*a*, and the lead-out pattern 4*a*. Since the lead-out pattern 4*a* is covered with the second overlay film 6, it is electrically insulated. The second overlay film 6 is approximately 15 μm in thickness, that is, is thicker than the first overlay films 5.

The second overlay film 6 includes flat top portions 6*a* provided on the first overlay films 5, and a concave portion 6*b* under which the first overlay films 5 are not provided on the lead-out pattern 4*a*. In FIG. 2, A represents the height from the surface of the insulating substrate 2 to the top portions 6*a*, and B represents the height from the surface of the insulating substrate 2 to the concave portion 6*b*. The height A is more than the height B.

A movable contact (not shown) formed of a reversing leaf spring is placed at a position shown by a two-dot chain line serving as an imaginary line 7 in FIG. 1. The movable contact is dome-shaped in an initial state. An outer peripheral portion of the movable contact on the left side in the figure is disposed on the first fixed contact 3, and an outer peripheral portion on the right side is disposed on the top portions 6*a* of the second overlay film 6.

Operation of the switch device 1 will now be described. When the top of the dome-shaped movable contact is pressed in the initial state, the movable contact is reversed to form a tactile feeling.

Simultaneously, a ceiling face of the movable contact touches the second fixed contact 4, and the first and second fixed contacts 3 and 4 are electrically connected by the movable contact, thereby turning a switch circuit on.

When the press of the movable contact is removed, the movable contact automatically returns to the dome-shaped initial shape by its elasticity, and consequently, the switch circuit is turned off.

In the switch device 1, the first overlay films 5 are approximately 10 μm in thickness, and the second overlay film 6 is approximately 15 μm in thickness. Therefore, even when the movable contact is repeatedly pressed, the second overlay film 6 slowly gets worn, and the life property is improved.

Even if the top portions 6*a* of the second overlay film 6 are worn by repetitive pressing of the movable contact, the outer peripheral portion of the movable contact touches the first overlay films 5, but does not touch the lead-out pattern 4*a* covered with the second overlay film 6. This also improves the life property of the switch circuit.

Further, since the lead-out pattern 4*a* is covered with the second overlay film 6, for example, even when conductive metal powder enters from the outside, improper operation is prevented from being caused by electrical connection between the movable contact and the lead-out pattern 4*a*.

While the first overlay films 5 are conductive films made of carbon ink, they may be insulating films like the second overlay film 6.

What is claimed is:

1. A switch device comprising:

an insulating substrate;

a first fixed contact that has a broken annular shape and that is cut out to form a cutout portion having a predetermined width so that a part of the insulating substrate is exposed from the cutout portion, the first fixed contact including a pair of cutout ends opposing each other across the part of the insulating substrate;

a second fixed contact provided inside the first fixed contact so as to be insulated from the first fixed contact;

a lead-out pattern extending from the second fixed contact to the outside of the first fixed contact;

a movable contact provided on the first fixed contact and formed of a reversing leaf spring;

a pair of first overlay films having a predetermined thickness and respectively provided on the cutout ends of the first fixed contact; and a second overlay film having a predetermined thickness and provided on the first overlay films, the part of the insulating substrate, and the lead-out pattern.

2. The switch device according to claim 1, wherein the sum of the thickness of the cut out ends, the thickness of the first overlay films, and the thickness of portions of the second overlay film disposed on the first overlay films is more than the sum of the thickness of the lead-out pattern and the thickness of a portion of the second overlay film provided on the lead-out pattern.

3. The switch device according to claim 1, wherein the first overlay films are made of the same material as a carbon film that covers a terminal of the first fixed contact, and the second overlay film is a resist film.

4. The switch device according to claim 1, wherein the first overlay films are 10 μm in thickness, and the second overlay film is 15 μm in thickness.

* * * * *